US005081838A

United States Patent [19]

Miyaoka et al.

[11] Patent Number: 5,081,838

[45] Date of Patent: Jan. 21, 1992

[54] HYDRAULIC CIRCUIT WITH VARIABLE RELIEF VALVES

[75] Inventors: Satoshi Miyaoka; Masaaki Tachinoh, both of Hiroshima, Japan

[73] Assignee: Kabushiki Kaisha Kobe Seiko Sho, Kobe, Japan

[21] Appl. No.: 329,823

[22] Filed: Mar. 28, 1989

[51] Int. Cl.[5] ..... F16D 31/02; E02F 5/02

[52] U.S. Cl. ..... 60/444; 60/468; 60/494; 37/103

[58] Field of Search ..... 60/443-444, 60/465, 468, 494, 427; 91/529, 451; 37/103

[56] References Cited

U.S. PATENT DOCUMENTS 4,365,429 12/1982 Ecker et al. ..... 37/103
4,481,770 11/1984 Lohbauer et al. ..... 60/468 X
4,628,690 12/1986 Arai et al. ..... 60/494 X

*Primary Examiner*—Edward K. Look

*Assistant Examiner*—John Ryznic

*Attorney, Agent, or Firm*—Oblon, Spivak, McClelland, Maier & Neustadt

[57] ABSTRACT

A hydraulic circuit for a hydraulic shovel includes a variable displacement hydraulic pump; selector valves communicated with the variable displacement hydraulic pump; actuators communicated with the selector valves; variable relief valves provided in a discharge oil passage of the variable displacement hydraulic pump and also provided in input oil passages of some of the actuators; a pilot hydraulic pump communicated with the variable relief valves through pilot oil passages; a solenoid valve provided in the pilot oil passage for changing set pressures of the variable relief valves; a regulator for controlling a discharge quantity of the variable displacement hydraulic pump; and a pilot oil passage for communicating the solenoid valve with the regulator.

2 Claims, 6 Drawing Sheets

HYDRAULIC CIRCUIT WITH VARIABLE RELIEF VALVES

BACKGROUND OF THE INVENTION

The present invention relates to a hydraulic circuit for a hydraulic shovel adapted to be operated with an increased capacity.

A hydraulic shovel is usually utilized for excavation, but in some case, it is used as a crane for hoisting an object, owing to its high working capacity. For example, a wire rope is hung on a hook fixed to a bucket, and a structure such as a steel pipe is hoisted via the wire rope by operating a boom cylinder and an arm cylinder. In such a hoisting operation, an operating force of the boom cylinder and the arm cylinder is increased by operating a switch located near an operating lever. The switch is operatively connected to a solenoid valve, and the solenoid valve is operatively connected to pilot-operated variable relief valves provided in a main circuit and port circuits of the boom cylinder and the arm cylinder. When the switch is turned on to operate the solenoid valve, set pressures of the variable relief valves are changed.

FIG. 7 shows a conventional hydraulic circuit of a hydraulic shovel as mentioned above. Reference numeral 50 designates a hydraulic pump communicated with a main oil passage 51. The main oil passage 51 is provided with a variable relief valve 52 including a pilot portion 53. The pilot portion 53 is communicated through a pilot oil passage 55 to a solenoid valve 54. The solenoid valve 54 is operated by a switch 56 provided on an operating lever 68.

Reference numeral 57 designates a port oil passage communicated with a head side oil chamber of a boom cylinder 58. The port oil passage 57 is provided with a variable relief valve 59 including a pilot portion 60. The pilot portion 60 is communicated through a pilot oil passage 61 to the solenoid valve 54. Similarly, reference numeral 62 designates a port oil passage communicated with a rod side oil chamber of an arm cylinder 63. The port oil passage 62 is provided with a variable relief valve 64 including a pilot portion 65. The pilot portion 65 is communicated through a pilot oil passage 66 to the solenoid valve 54.

In the case of increasing the hoisting capacity of the boom cylinder and the arm cylinder, the switch 56 of the operating lever 68 is depressed. As a result, the solenoid valve 54 is operated to allow pilot oil from a pilot hydraulic pump 67 to flow through the solenoid valve 54 to the pilot portions 53, 60 and 65 of the relief valves 52, 59 and 64. Accordingly, the set pressures of the relief valves 52, 59 and 64 are increased, thereby increasing operating pressures of the boom cylinder 58 and the arm cylinder 63. Thus, the working capacity of the hydraulic shovel as a crane can be increased.

However, as the set pressure of the variable relief valve 52 provided in the main oil passage 51 is increased, hydraulic pressures of any actuators other than the boom cylinder 58 and the arm cylinder 63 are unnecessarily increased, causing adverse affects on any other hydraulic equipment and structures such as a reduction in durability of the hydraulic equipments or breakage of the structures.

Furthermore, in the event that the hydraulic shovel is used as a normal excavator with an increased working capacity, the hydraulic equipment of the actuators such as a bucket cylinder and a traveling motor which are not required to has increased working capacity are adversely affected to cause a reduction in durability. Further, the structures relating to the actuators are also adversely affected to cause breakage thereof.

SUMMARY OF THE INVENTION

It is a primary object of the present invention to provide a hydraulic circuit for a hydraulic shovel which may reduce a discharge quantity of a variable displacement hydraulic pump in the case of increasing a capacity of some of actuators, and thereby prevent damage of a hydraulic equipment and a reduction in durability.

It is another object of the present invention to provide a hydraulic circuit for a hydraulic shovel which may render inoperative some of actuators not required to increase a capacity thereof, and thereby prevent breakage of a related hydraulic equipment and structure.

According to a first aspect of the present invention, there is provided a hydraulic circuit for a hydraulic shovel, comprising a variable displacement hydraulic pump; selector valves communicated with said variable displacement hydraulic pump; actuators communicated with said selector valves; variable relief valves provided in a discharge oil passage of said variable displacement hydraulic pump and also provided in input oil passages of some of said actuators; a pilot hydraulic pump communicated with said variable relief valves through pilot oil passages; a solenoid valve provided in said pilot oil passage for changing set pressures of said variable relief valves; a regulator for controlling a discharge quantity of said variable displacement hydraulic pump; and a pilot oil passage for communicating said solenoid valve with said regulator.

According to a second aspect of the present invention, there is provided a hydraulic circuit for a hydraulic shovel, comprising a variable displacement hydraulic pump; selector valves communicated with said variable displacement hydraulic pump; actuators communicated with said selector valves; variable relief valves provided in a discharge oil passage of said variable displacement hydraulic pump and also provided in input oil passages of some of said actuators; a pilot hydraulic pump communicated with said variable relief valves through pilot oil passages; a first solenoid valve provided in said pilot oil passage for changing set pressures of said variable relief valves; a regulator for controlling a discharge quantity of said variable displacement hydraulic pump; a pilot oil passage for communicating said first solenoid valve with said regulator; and a second solenoid valve provided in a pilot oil passage communicated with said regulator, said second solenoid valve being interlocked with said solenoid valve for operating said variable relief valves.

According to a third aspect of the present invention, there is provided a hydraulic circuit for a hydraulic shovel, comprising a variable displacement hydraulic pump; selector valves communicated with said variable displacement hydraulic pump; actuators communicated with said selector valves; variable relief valves provided in a discharge oil passage of said variable displacement hydraulic pump and also provided in input oil passages of some of said actuators; a pilot hydraulic pump communicated with said variable relief valves through pilot oil passages; a first solenoid valve provided in said pilot oil passage for changing set pressures of said variable relief valves; and a second solenoid valve provided in pilot oil passages communicated with some of said selector valves for operating some of said actuators having unchanged relief pressure, said second solenoid valve being interlocked with said first solenoid valve for operating said variable relief valves.

According to a fourth aspect of the present invention, there is provided a hydraulic circuit for a hydraulic shovel, comprising a variable displacement hydraulic pump; selector valves communicated with said variable displacement hydraulic pump; actuators communicated with said selector valves; variable relief valves provided in a discharge oil passage of said variable displacement hydraulic pump and also provided in input oil passages of some of said actuators; a pilot hydraulic pump communicated with said variable relief valves through pilot oil passages; a solenoid valve provided in said pilot oil passage for changing set pressures of said variable relief valves; and a pilot selector valve provided in pilot oil passages communicated with some of said selector valves for operating some of said actuators having unchanged relief pressure, said pilot selector valve being communicated with said pilot oil passages communicated with said variable relief valves.

According to a fifth aspect of the present invention, there is provided a hydraulic circuit for a hydraulic shovel, comprising a variable displacement hydraulic pump; selector valves communicated with said variable displacement hydraulic pump; actuators communicated with said selector valves; variable relief valves provided in a discharge oil passage of said variable displacement hydraulic pump and also provided in input oil passages of some of said actuators; a pilot hydraulic pump communicated with said variable relief valves through pilot oil passages; a solenoid valve provided in said pilot oil passage for changing set pressures of said variable relief valves; a regulator for controlling a discharge quantity of said variable displacement hydraulic pump; a pilot oil passage for communicating said solenoid valve with said regulator; and a pilot selector valve provided in a pilot oil passage communicated with said solenoid valve for operating said variable relief valves.

In summary, when the discharge pressure of the variable displacement hydraulic pump is negative-controlled, a shuttle valve is provided in the oil passage communicated with a regulator of the hydraulic pump, and the regulator is communicated through a pilot oil passage to the main solenoid valve for controlling pilot pressures of the relief valves. On the other hand, when the discharge pressure of the variable displacement hydraulic pump is positive-controlled, a solenoid valve or a pilot selector valve is provided in the oil passage communicated with the regulator. The solenoid valve or the pilot selector valve is interlocked with the main solenoid valve for controlling the pilot pressures of the relief valves, so that the regulator may be controlled in interlocking relationship with the main solenoid valve.

In a pilot circuit for the selector valves for controlling some of the actuators not required to increase the capacity thereof, a solenoid valve or a pilot selector valve is so provided as to be interlocked with the main solenoid valve for controlling the pilot pressures of the relief valves. The solenoid valve or the pilot selector valve operates to render inoperative some of the actuators not required to increase the capacity thereof.

Accordingly, when the main solenoid valve is operated to increase the set pressures of the relief valves and thereby increase the capacity of some of the actuators, the discharge quantity of the variable displacement hydraulic pump is reduced to slow an operating speed of the actuators. Therefore, surge pressures at starting and stopping the actuators can be reduced to thereby prevent damage of the hydraulic equipment and a reduction in durability thereof.

Moreover, as some of the actuators not required to increase the capacity thereof can be rendered inoperative, it is possible to prevent breakage of the related hydraulic equipment and structure.

Other objects and features of the invention will be more fully understood from the following detailed description and appended claims when taken with the accompanying drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
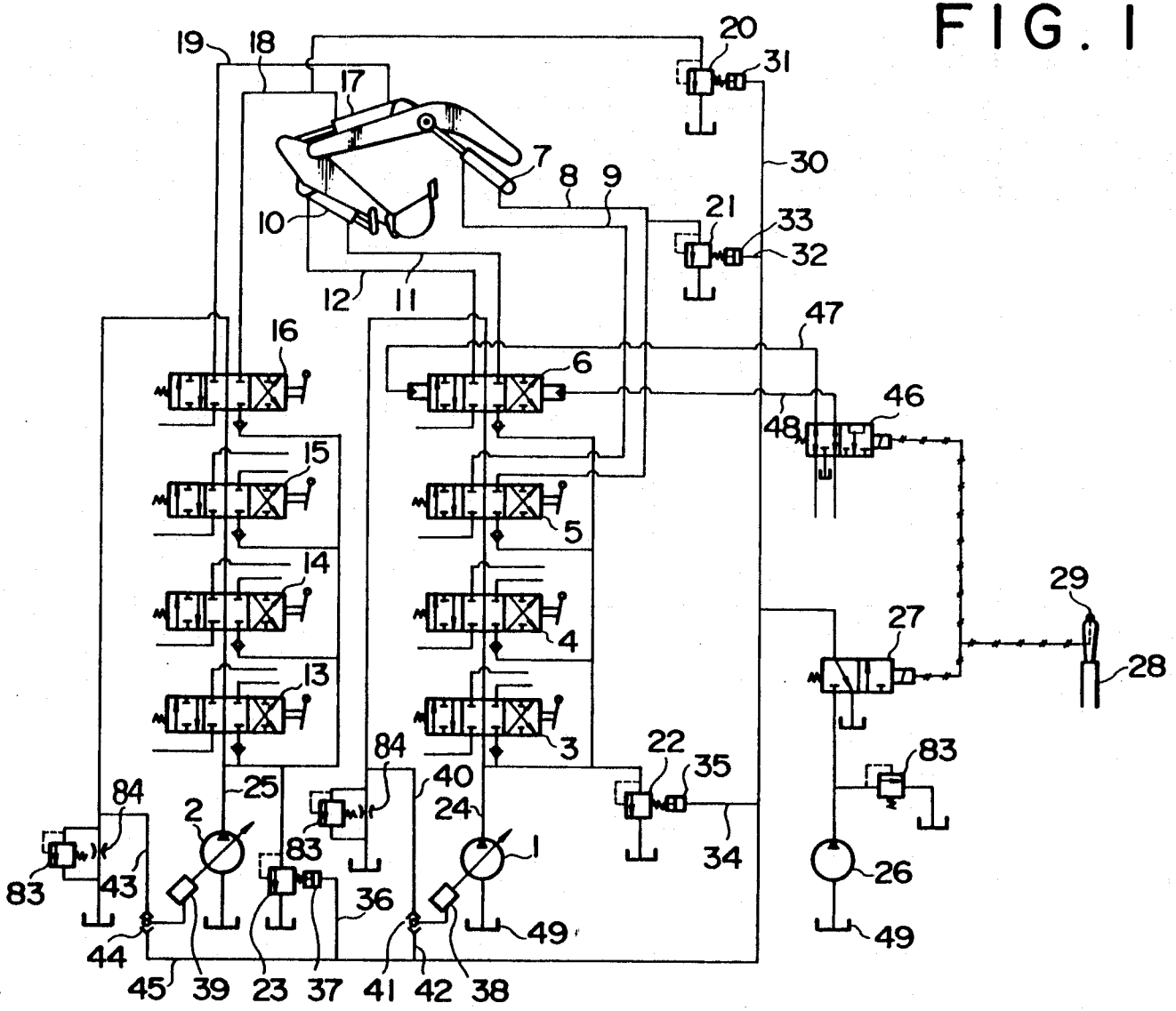
FIG. 1 is a hydraulic circuit diagram of a first preferred embodiment of the present invention.
Figure 2:
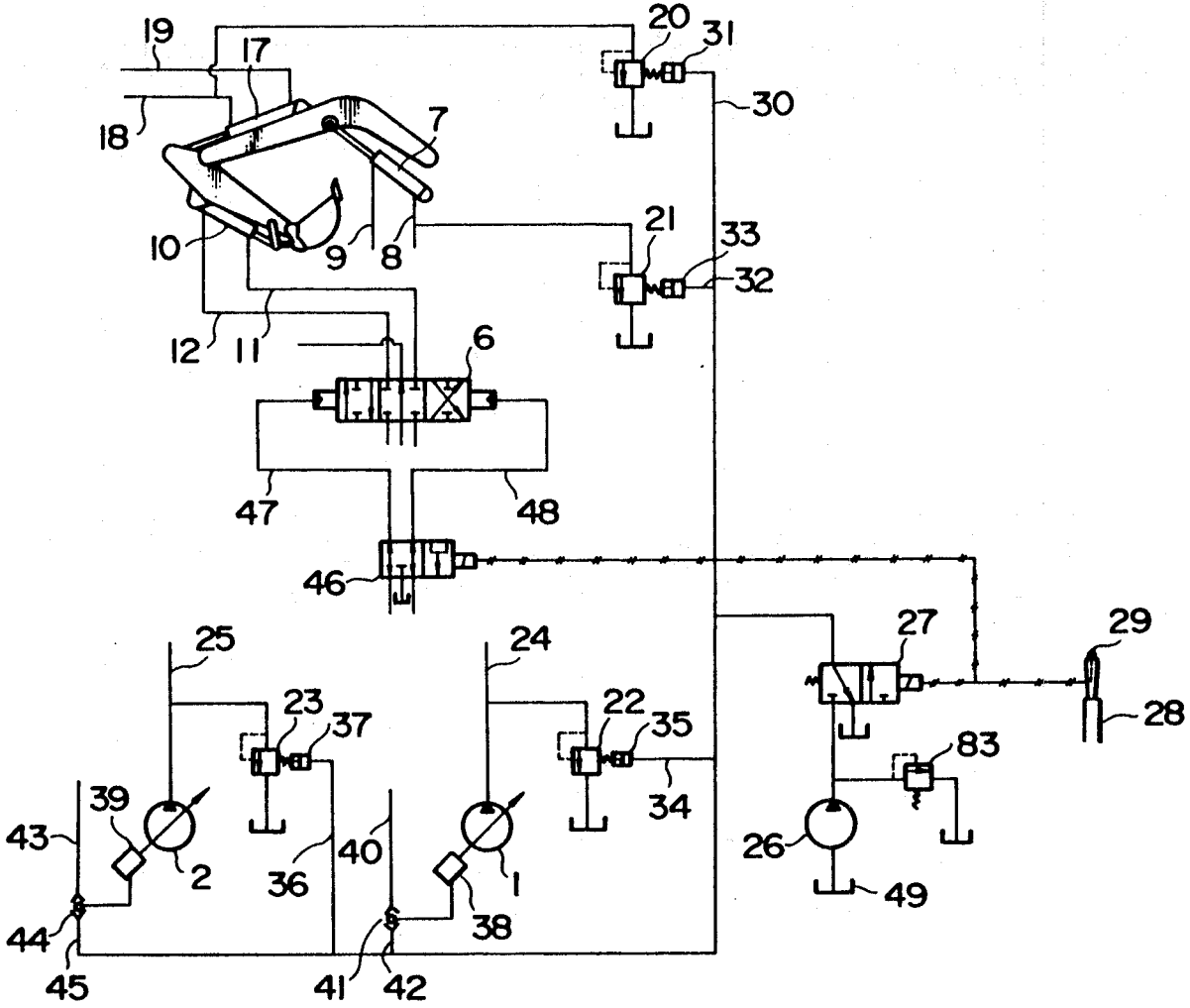
FIG. 2 is a hydraulic circuit diagram of an essential part in FIG. 1.

Referring to FIGS. 1 and 2 which show a preferred embodiment of the present invention, reference numerals 1 and 2 designate variable displacement hydraulic pumps, and reference numerals 3, 4, 5 and 6 designate selector valves adapted to be supplied with pressure oil from the hydraulic pump 1. The selector valve 5 is provided to operate a boom cylinder 7, and oil passages 8 and 9 are provided to communicate the selector valve 5 with the boom cylinder 7. The selector valve 6 is provided to operate a bucket cylinder 10, and oil passages 11 and 12 are provided to communicate the selector valve 6 with the bucket cylinder 10. Reference numerals 13, 14, 15 and 16 designate selector valves adapted to be supplied with pressure oil from the hydraulic pump 2. The selector valve 16 is provided to operate an arm cylinder 17, and oil passages 18 and 19 are provided to communicate the selector valve 16 with the arm cylinder 17.

Reference numerals 20, 21, 22 and 23 designate variable relief valves. The variable relief valve 20 is provided in the oil passage 18 communicated with a rod side oil chamber of the arm cylinder 17. The variable relief valve 21 is provided in the oil passage 8 communicated with a head side oil chamber of the boom cylinder 7. The variable relief valve 22 is provided in a main oil passage 24 of the hydraulic pump 1. The variable relief valve 23 is provided in a main oil passage 25 of the hydraulic pump 2.

Reference numerals 26 and 27 designate a pilot hydraulic pump and a solenoid valve, respectively. The solenoid valve 27 is provided to switch feed of pilot oil to be supplied from the pilot hydraulic pump 26 to the variable relief valves 20–23. The solenoid valve 27 is operated by a switch 29 provided on an operating lever 28. A pilot oil passage 30 is provided to communicate the solenoid valve 27 with a pilot portion 31 of the variable relief valve 20. A pilot oil passage 32 is provided to communicate the solenoid valve 27 with a pilot portion 33 of the variable relief valve 21. A pilot oil passage 34 is provided to communicate the solenoid valve 27 with a pilot portion 35 of the variable relief valve 22. A pilot oil passage 36 is provided to communicate the solenoid valve 27 with a pilot portion 37 of the variable relief valve 23. Accordingly, when the switch 29 is depressed, the solenoid valve 27 is opened to permit the pilot oil from the pump 26 to flow into the pilot portions 31, 33, 35 and 37 and thereby increase the set pressures of the relief valves 20–23.

Reference numerals 38 and 39 designate regulators for the variable displacement hydraulic pumps 1 and 2, the regulator 38 is communicated with the selector valve 6 through a return oil passage 40 in a neutral position of the selector valve 6. The return oil passage 40 is provided with a shuttle valve 41. The shuttle valve 41 is communicated with the solenoid valve 27 through a pilot oil passage 42, so as to control a discharge quantity of the hydraulic pump 1 by the operation of the solenoid valve 27. Similarly, the regulator 39 is communicated with the selector valve 16 through a return oil passage 43 in a neutral position of the selector valve 16. The return oil passage 43 is provided with a shuttle valve 44. The shuttle valve 44 is communicated with the solenoid valve 27 through a pilot oil passage 45, so as to control a discharge quantity of the hydraulic pump 2 by the operation of the solenoid valve 27.

Reference numeral 46 designates a second solenoid valve for operating the selector valve 6 as a pilot selector valve. The solenoid valve 46 is communicated with the selector valve 6 through pilot oil passages 47 and 48. The solenoid valve 46 is operated by the switch 29 of the operating lever 28 in the same manner as the solenoid valve 27. That is, when the switch 29 is on, both the oil passages 47 and 48 are communicated with a tank 49, and the selector valve 6 is returned to its neutral position. As a result, the bucket cylinder 10 is not operated. Reference numerals 83 designate normal type relief valves, and reference numerals 84 designate restrictions.

In operating the hydraulic shovel normally as an excavator, the selector valves 5, 6 and 16 are operated to feed the pressure oil from the hydraulic pumps 1 and 2 to the boom cylinder 7, the bucket cylinder 10 and the arm cylinder 17, respectively, thereby operating these cylinders and conducting excavation. In this case, as the switch 29 is not operated, both the solenoid valves 27 and 46 are in the neutral position. Accordingly, the pump circuit communicated with the solenoid valve 27 is shut off, and no pilot oil is therefore supplied to the pilot portions 31, 33, 35 and 37. Accordingly, the relief valves 20, 21, 22 and 23 operate as relief valves having normal set pressures. The shuttle valves 41 and 44 are not supplied with oil from the oil passages 42 and 45 but are supplied with oil from the oil passages 40 and 43. Accordingly, the regulators 38 and 39 operate under a normal condition, and a discharge quantity of the hydraulic pumps 1 and 2 is therefore normally controlled by the regulators 38 and 39.

On the other hand, in utilizing the hydraulic shovel for any other purposes such as a crane for hoisting an object, the switch 29 of the operating lever 28 is turned on to operate the solenoid valves 27 and 46. That is, the pump circuit of the solenoid valve 27 is opened. Simultaneously, the oil passages 47 and 48 communicated with the solenoid valve 46 are shut off.

As the solenoid valve 27 is opened, the pressure oil is fed from the pilot hydraulic pump 26 through the solenoid valve 27 and the oil passage 30 to the pilot portion 31. Simultaneously, the pressure oil from the pilot hydraulic pump 26 is also fed through the oil passage 32 to the pilot portion 33, through the oil passage 34 to the pilot portion 35, and through the oil passage 36 to the pilot portion 37. Accordingly, the set pressures of the variable relief valves 20–23 are increased. As a result, relief pressures of the actuators communicated through the oil passages 18, 8, 24 and 25 to the relief valves 20, 21, 22 and 23, respectively, that is, a relief pressure of the arm cylinder 17 on the rod side, a relief pressure of the boom cylinder 7 on the head side, and the like are increased, thereby increasing the operating forces of these actuators. In other words, a hoisting capacity of the hydraulic shovel when used as a crane can be increased.

As mentioned above, when the switch 29 is turned on, the solenoid valve 46 is operated to shut off the oil passages 47 and 48 communicated with the selector valve 6 for actuating the bucket cylinder 10. That is, the selector valve 6 is returned to its neutral position, and the bucket cylinder 10 cannot be operated. Thus, when the hydraulic shovel is used as a hoisting machine, the bucket cylinder 10 which does not contribute to a hoisting performance is prevented from being operated. If the bucket cylinder 10 were operated under the increased set pressures of the relief valves 20–23, a hydraulic equipment and a structure relating to the bucket cylinder 10 would be adversely affected to cause a reduction in durability of the hydraulic equipment or breakage of the structure. Consequently, such possible problems can be eliminated by rendering the bucket cylinder 10 inoperative. Such a safety mechanism may be applied to a traveling motor (not shown) and the like as well as the bucket cylinder 10 other than the boom cylinder 7 and the arm cylinder 17, so as to eliminate the above-mentioned possible problems.

Figure 3:
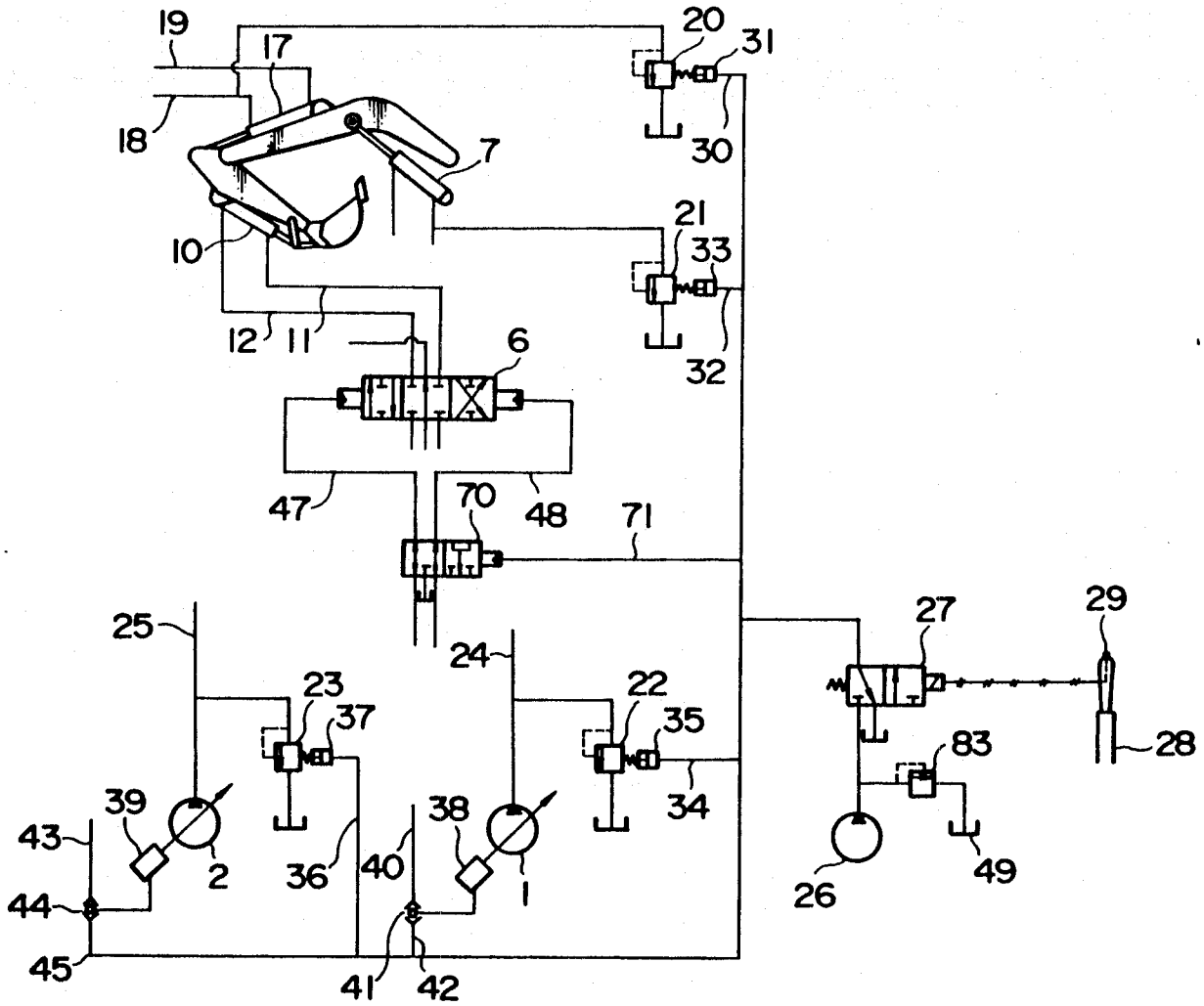
FIGS. 3 to 6 are hydraulic circuit diagrams of the other preferred embodiments of the present invention.

Although the selector valve 6 is operated by the solenoid valve 46 to be operated by the switch 29 in the above preferred embodiment, the solenoid valve 46 may be replaced by a pilot selector valve 70 as shown in FIG. 3. The pilot selector valve 70 is communicated with the solenoid valve 27 through an oil passage 71 which is the same oil passage as the oil passages 30, 32, 34 and 36 leading to the pilot portions 31, 33, 35 and 37 of the relief valves 20, 21, 22 and 23. When the switch 29 is turned on to open the solenoid valve 27, the pilot pressure of the pilot hydraulic pump 26 is applied to the relief valves 20–23, and simultaneously the pilot pressure is also applied to the pilot selector valve 70. As a result, the oil passages 47 and 48 communicated with the selector valve 16 are shut off to render the bucket cylinder 10 inoperative.

Figure 4:
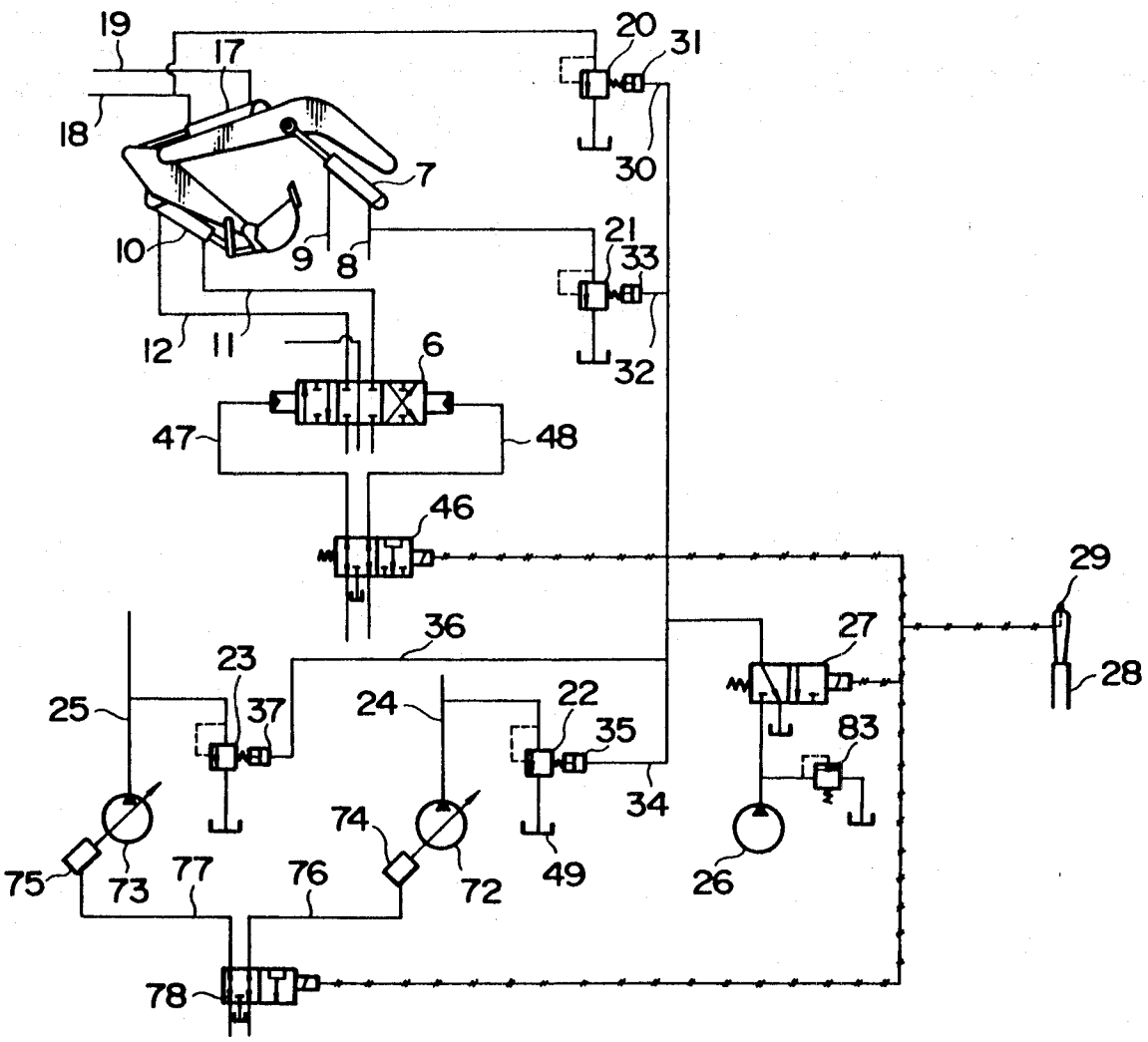

While the regulators 38 and 39 of the variable displacement hydraulic pumps 1 and 2 are negative-controlled in the above description (i.e., pump capacity is decreased with increased regulator pressure), they may be positive-controlled (i.e., pump capacity is increased with increased regulator pressure) as shown in FIG. 4. Referring to FIG. 4, reference numeral 78 designates a solenoid valve provided in oil passages 76 and 77 communicated with regulators 74 and 75 of variable displacement hydraulic pumps 72 and 73. The solenoid valve 78 is operated by the switch 29. When the switch 29 is off, the oil passages 76 and 77 are opened, while when the switch 29 is on, both the regulators 74 and 75 are communicated with the tank 49.

Figure 5:
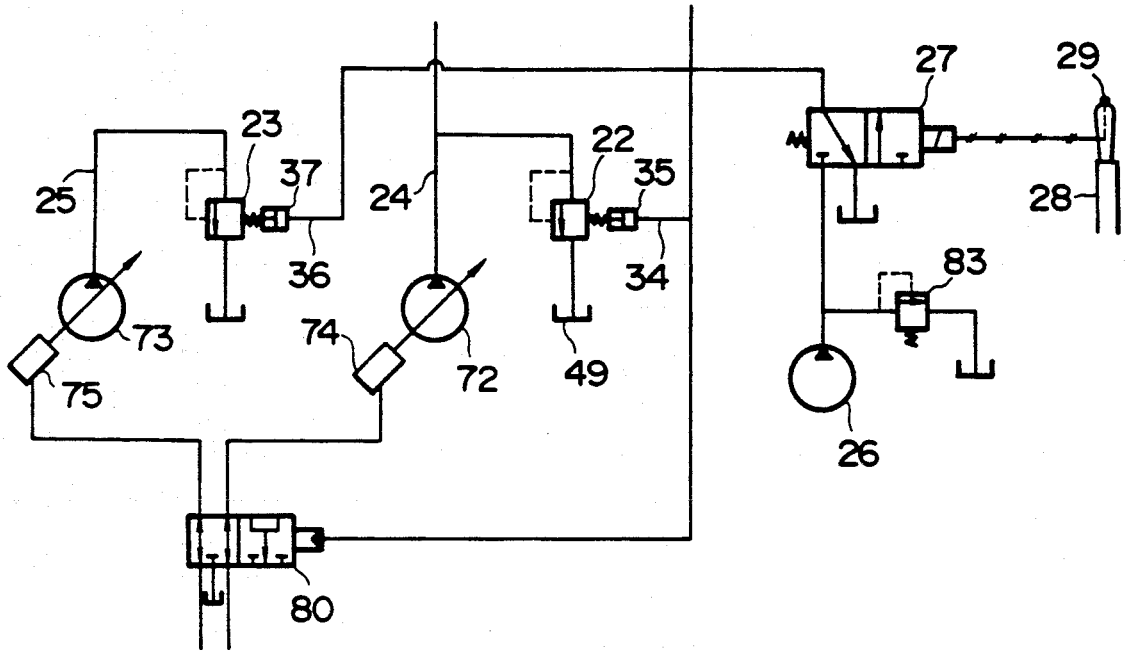

Referring to FIG. 5 which shows another preferred embodiment wherein the solenoid valve 78 shown in FIG. 4 is replaced by a pilot selector valve 80, a pilot oil passage of the pilot selector valve 80 is communicated with the solenoid valve 27 for changing the set pressures of the relief valves. When the switch 29 is turned on, the solenoid valve 27 is operated to allow the pressure oil from the hydraulic pump 26 to reach the relief valves 20–23. Simultaneously, the pressure oil is also supplied to the pilot selector valve 80, and the regulators 74 and 75 are communicated with the tank 49. Accordingly, a discharge quantity of the hydraulic pumps 72 and 73 is reduced.

Figure 6:
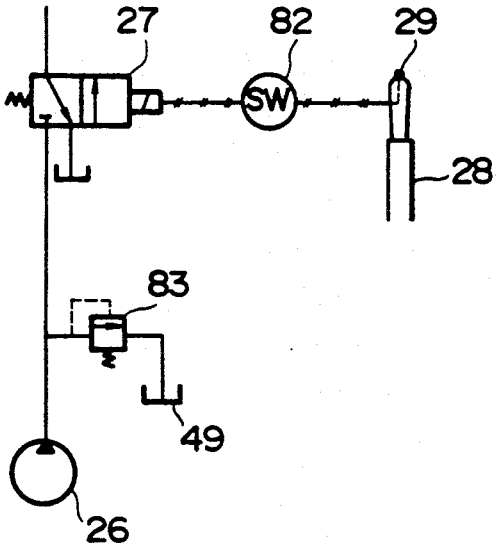
Figure 7:
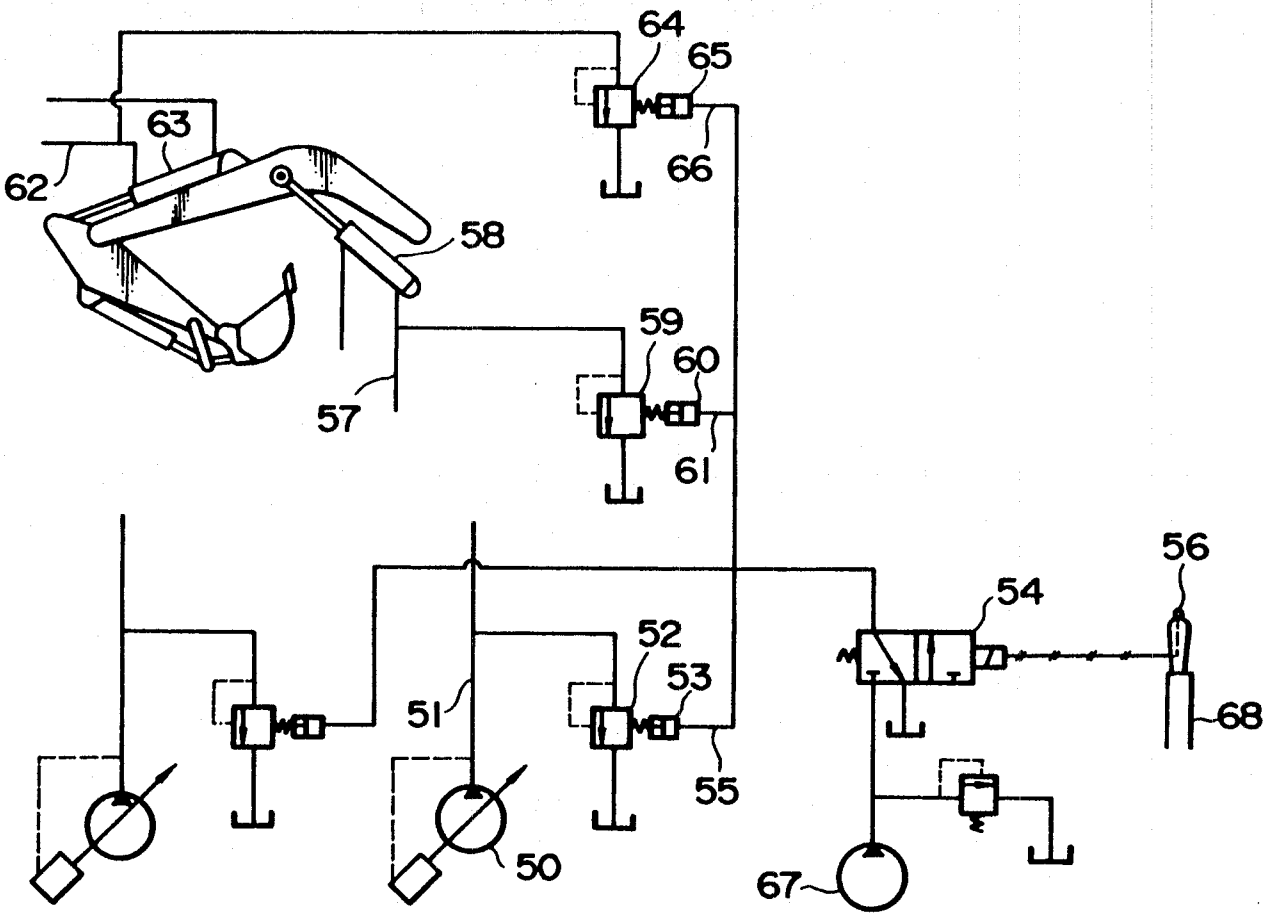
FIG. 7 PRIOR ART
FIG. 7 is a hydraulic circuit diagram in the prior art.

While the operation of the solenoid valve 27 is effected by continuously depressing the switch 29 in the above description, such continuous depression by an operator may be made unnecessary by providing a rotary switch 82 between the switch 29 and the solenoid valve 27 as shown in FIG. 6. When the switch 29 is depressed once, the rotary switch 82 is turned on to effect the operation of the solenoid valve 27. When the switch 29 is depressed again, the rotary switch 82 is turned off to close the solenoid valve 27. Thus, the operator is not required to continue to depress the switch 29 during the operation.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A hydraulic circuit for a hydraulic shovel, comprising:

a variable displacement hydraulic pump;

selector valve for selectively transmitting hydraulic fluid from said hydraulic pump;

actuators for actuating said shovel and communicated with said selector valves such that hydraulic fluid from said hydraulic pump may be delivered to said actuators via said selector valves;

at least one variable relief valve provided in a discharge oil passage of said variable displacement hydraulic pump at a fluidic position between said hydraulic pump and said selector valves and also provided in input oil passages of at least one of said actuators;

a pilot hydraulic pump communicated with said variable relief valves through pilot oil passages;

a solenoid valve provided in one of said pilot oil passages for changing set pressures of said variable relief valves;

a regulator for controlling a discharge quantity of said variable displacement hydraulic pump; and a pilot oil passage for communicating said solenoid valve with said regulator so as to control a discharge quantity of said hydraulic pump by operation of said solenoid valve, according to the pressure of said pilot pump and independent of a discharge pressure of said variable displacement hydraulic pump.

2. A hydraulic circuit for a hydraulic shovel as defined in claim 1 further comprising a second solenoid valve provided in a pilot oil passage communicated with at least one of said selector valves for controlling said one of said selector valves, and means for simultaneously actuating said second solenoid valve and said solenoid valve.

* * * * *